United States Patent [19]

Nishioka

[11] Patent Number: 4,693,229

[45] Date of Patent: Sep. 15, 1987

[54] PROJECTILE SHOOTING GUIDE FOR BOWS

[76] Inventor: Jim Z. Nishioka, 268 Hemlock NW., Salem, Oreg. 97304

[21] Appl. No.: 836,698

[22] Filed: Mar. 6, 1986

[51] Int. Cl.[4] ..... F41D 10/00; F41B 5/00; F41B 15/00; A63B 65/02

[52] U.S. Cl. ..... 124/41 A; 124/24 R; 273/416

[58] Field of Search ..... 273/416; 124/23 R, 24 R, 124/25, 26, 21, 41 A, 41 R

[56] References Cited

U.S. PATENT DOCUMENTS

| | | | |
|---|---|---|---|
| 1,210,332 | 12/1916 | Kvistad | 124/24 R |
| 1,526,176 | 2/1925 | O'Connell | 124/24 R |
| 2,125,591 | 8/1938 | Smith | 124/24 R |
| 2,516,341 | 7/1950 | Raffeis | 124/25 |
| 3,031,797 | 5/1962 | Gelfand | 446/65 |
| 3,191,342 | 6/1965 | Chalmers | 446/231 |
| 3,214,174 | 10/1965 | Saunders | 273/416 |
| 3,435,952 | 12/1969 | Jones | 124/25 |
| 3,572,311 | 3/1971 | Baer | 124/20 R |
| 4,027,645 | 6/1977 | Damron | 124/24 R |
| 4,146,009 | 3/1979 | Adams | 124/88 |
| 4,290,407 | 9/1981 | Damron | 124/41 A |
| 4,291,664 | 9/1981 | Nishioka | 124/41 A |
| 4,385,618 | 5/1983 | Nishioka | 124/24 R |
| 4,446,844 | 5/1984 | Nishioka | 124/24 R |
| 4,615,326 | 10/1986 | Rathbun | 124/88 |

*Primary Examiner*—Richard C. Pinkham
*Assistant Examiner*—Benjamin Layno

[57] ABSTRACT

A projectile shooting guide includes an elongated guide member to be mounted on a bow by a support and in its mounted position the guide member extends towards the bowstring. The shooting guide also includes a device to allow vertical movement of the guide member during a drawing movement of the shooting guide. The guide member is pivotable and in its pivoted position a resilient device urges the guide member to remain pivoted. Projectile loading is accomplished in the preferred embodiment by a moving pivotable portion of the guide member. Other embodiments employ spring, hinged or sliding loading devices. The guide member also includes a bowstring slot extending longitudinally in the guide member which allows drawing and shooting movements of the bowstring. The rearward end of the slot narrows to guide the bowstring to the lateral center of such slot. A projectile is included for use with the shooting guide. Such projectile includes a grooved portion to engage and align with an elongated ridge portion on the guide member.

14 Claims, 20 Drawing Figures

FIG. 6
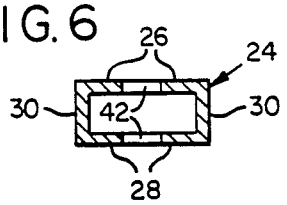
FIG. 1
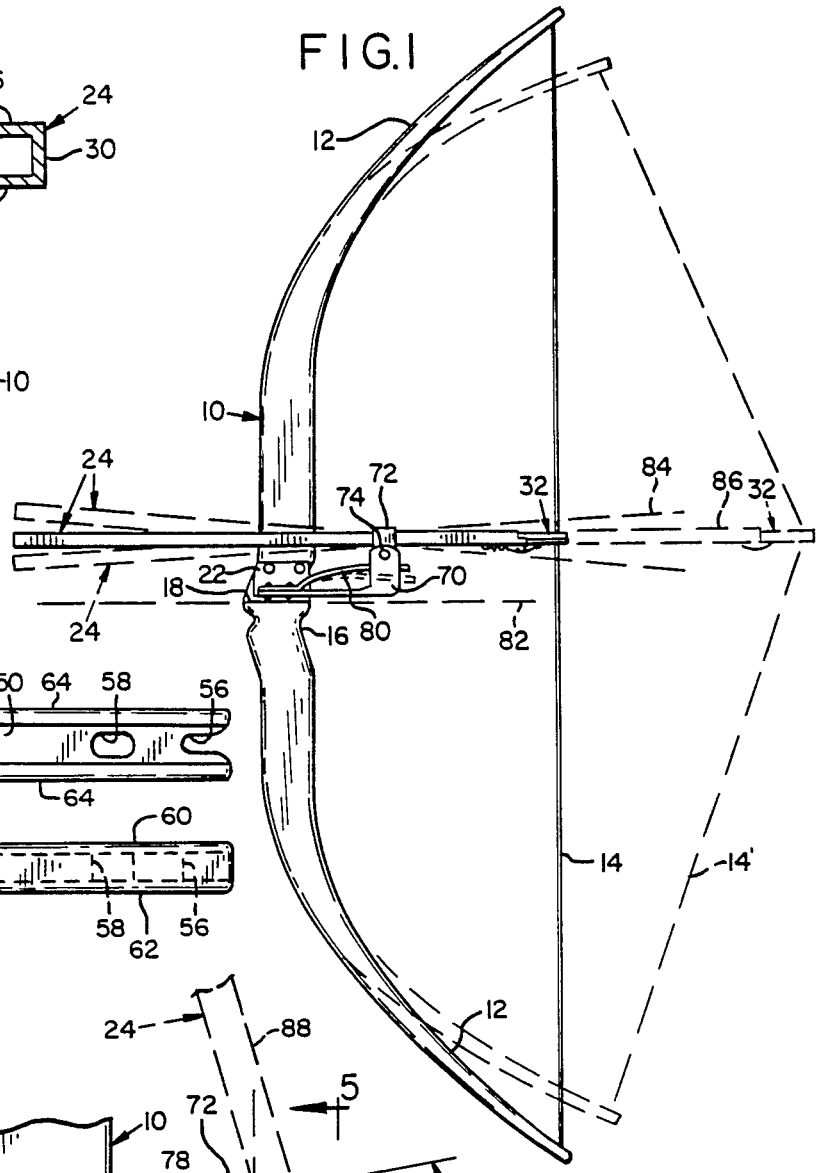
FIG. 5
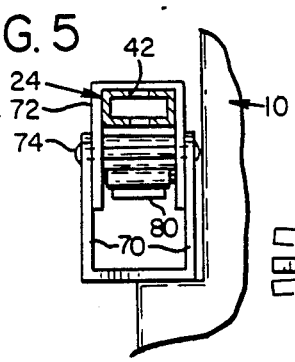
FIG. 2A
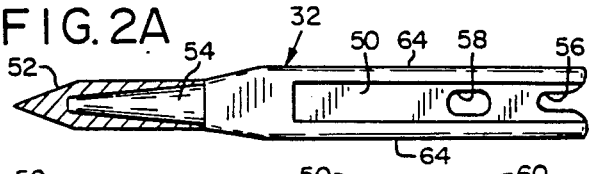
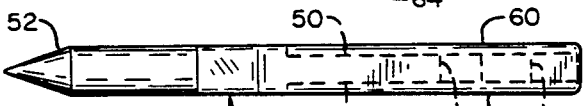
FIG. 2B
FIG. 4
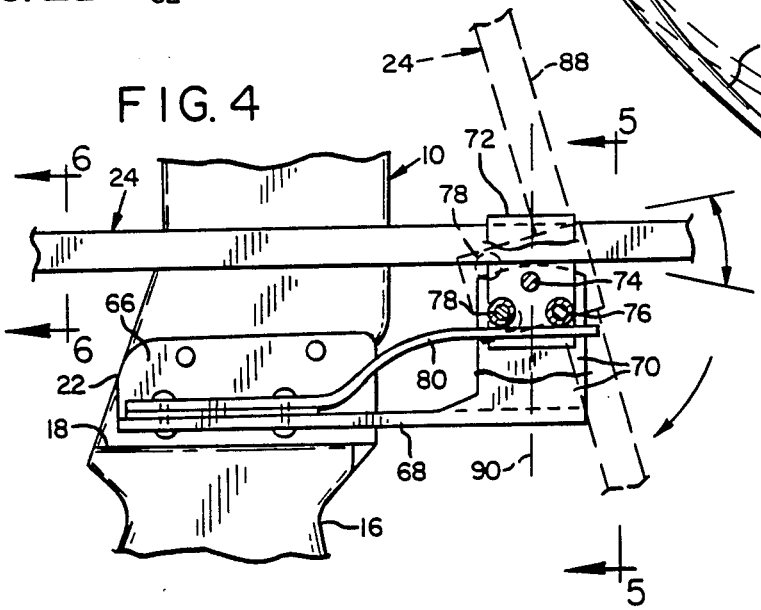
FIG. 3
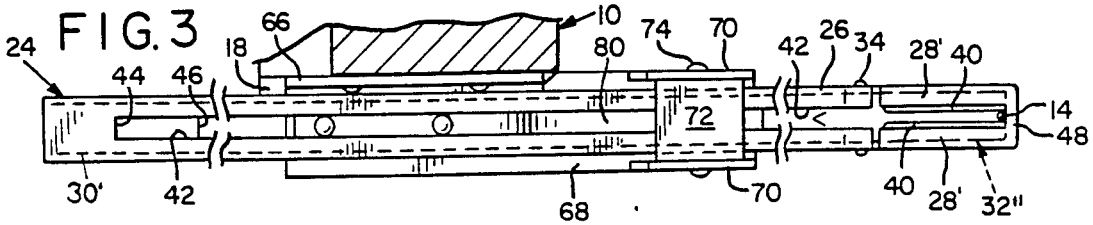

PROJECTILE SHOOTING GUIDE FOR BOWS

FIELD OF THE INVENTION

This invention relates to new and useful improvements in projectile shooting guides and projectiles for bows.

SUMMARY OF THE INVENTION

According to the present invention and forming primary objectives thereof, a projectile shooting guide and a projectile for use with bows are provided having novel structural arrangements.

Some prior structures include the Baer U.S. Pat. No. 3,572,311, issued Mar. 23, 1971, and discloses a guide member which does not slide and employs a projectile loading magazine which is activated by drawing the bowstring rearwardly to a fully drawn position. The applicant's two previous U.S. Patents, U.S. Pat. No. 4,291,664, issued Sept. 29, 1981, and 4,385,618 issued May 31, 1983, disclose projectile shooting guides which employ guide members which are slidable rearwardly with a drawing motion of the bowstring. The shooting guides include supports for slidably supporting guide members while restricting rotating movements of such guide members during drawing movements. Applicant's U.S. Pat. No. 4,291,664 also discloses a guide member and support which pivot on the bow frame.

In carrying out the present invention a shooting guide is provided which allows vertical movements of the guide member during rearward drawing and forward propelling movements of the bowstring.

The present invention also provides a shooting guide which can be loaded and unloaded with the guide member in a forwardly or undrawn position.

The present invention also provides a shooting guide and projectile combination which is simple in design, economical to manufacture and suitable for high volume production. The projectile has an elongated groove which extends parallel to the projectile side portions. The guide member has an elongated ridge which extends parallel to the guide member, such ridge originating and terminating in the rearward portion of the guide member. The projectile in the preferred embodiment of the present invention has a flat top and a flat bottom extending to the opposite sides. The groove extends forwardly from the rearward end of the projectile.

The present invention also provides a shooting guide which includes a bowstring slot which will laterally center the bowstring when it is positioned in the rearward portion of the guide member.

The present invention also provides a support which includes a pivoting portion and a non-pivoting portion. Such support allows the guide member to move to a position substantially parallel to the longitudinal axis of the bow for easy handling.

The invention will be better understood and additional objects and advantages will become apparent from the following description taken in conjunction with the accompanying drawings.

BRIEF DESCRIPTION OF THE DRAWINGS

FIG. 1 is a side elevational view of a bow and a first form of shooting guide and projectile embodying principles of the present invention;

FIG. 2A is a top plan view of the projectile;

FIG. 2B is a side elevational view of the projectile of FIG. 2A;

FIG. 3 is a top plan view of the shooting guide;

FIG. 4 is a side elevational view showing details of the support of the shooting guide;

FIG. 5 is a vertical sectional view taken on line 5—5 of FIG. 4;

FIG. 6 is a vertical sectional view taken on line 6—6 of FIG. 4;

DETAILED DESCRIPTION OF THE PREFERRED EMBODIMENTS

Figure 7:
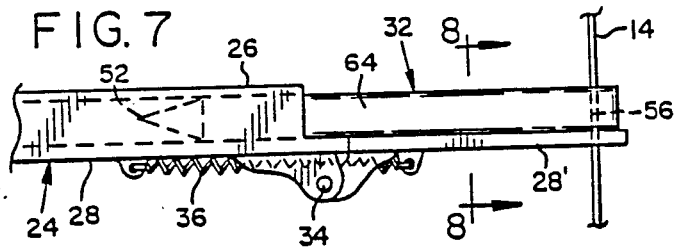
FIG. 7 is a side elevational view showing details of the rear portion of the guide member with the projectile in the loaded position.
Figure 8:
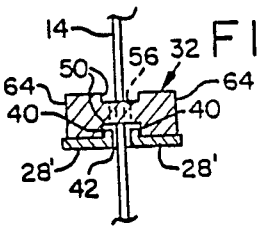
FIG. 8 is a vertical sectional view taken on line 8—8 of FIG. 7.

With reference first to FIG. 1, the present invention is arranged for use with a conventional archery bow having a frame portion 10 and bow limbs 12 or other tensioning means. A bowstring 14 is connected between the limbs, and the bow has the usual hand grip portion 16 and an arrow shelf 18.

A first form of the guide is shown in FIGS. 1-9 and comprises a support 22 arranged to be secured to the frame 10 of the bow just above the arrow shelf 18. In a preferred construction, the guide member 24 is slidably and non-rotatably supported by the support 22. The guide member includes an elongated top portion comprising a pair of top rails 26, FIG. 6, an elongated bottom portion comprising a pair of bottom rails 28 and opposite side portions 30. The rearward portion of the bottom rails includes a movable or pivotable portion 28' for loading a projectile 32 into the guide member. Such portion 28' pivots on a shaft 34, FIG. 7, and when closed to a shooting position, the movable portion is urged to maintain such closed position by a spring 36. When the movable portion is pivoted to the open position for loading the projectile the spring urges such movable portion to maintain the open position. The over-centering action of the spring in relation to the shaft can be seen in FIG. 9, the open position of the movable portion being indicated by broken lines 28'' and the spring by broken lines 36'.

Another important feature is that the projectile can be loaded and unloaded while the guide member is in the forwardly or undrawn position. This allows safe and easy loading and unloading of the projectile.

Figure 9:
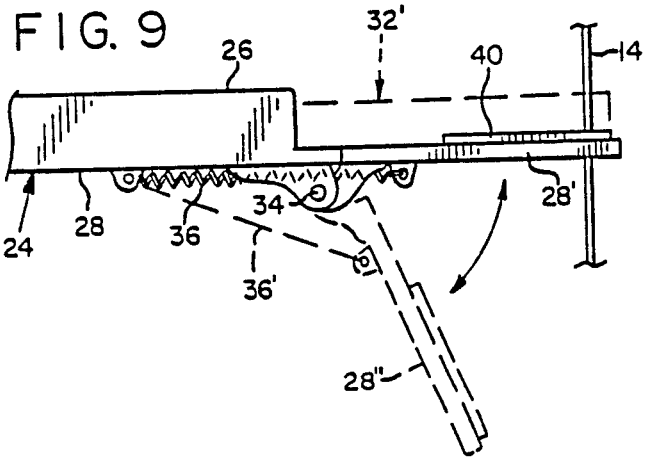
FIG. 9 is a side elevational view showing details of the rear portion of the guide member.

Raised portions or aligning ridges 40 for aligning the projectile 32 in a loaded position in the rearward portion of the guide member 24, best seen in FIGS. 3 and 9, extend longitudinally along a bowstring slot 42. Such raised portions restrict the projectile's lateral and rotating movements during its initial forwardly shooting movements. The slot allows the bowstring to move in the guide member during shooting motions of the guide. The slot includes a forward portion and a rearward portion and such slot narrows in the rearward portion to align the bowstring with the projectile. The slot is formed by connecting webs 44 and 46 on the forward portion of the guide member, FIG. 3, and connecting web 48 on the rearward portion of the guide member. The ridges 40 extend longitudinally and parallel to the elongated bottom rails 28 and to the bowstring slot. In the embodiment shown the ridges start and terminate on the rearward portion of the guide member but can be extended into the forward portion of the guide member. Broken lines 32'', FIG. 3, indicate the position of the projectile and 30' indicates side portions 30.

When the projectile 32 is loaded into the guide member, ridges 40 engage recesses or grooves 50 on recesses or projectile. This aligns the projectile with the guide member during drawing and initial forward shooting movements. This is an important feature since the top rails 26 of the guide member terminate forwardly of the rearward end of the guide member. Such termination of the top rails is desirable since it exposes the projectile for visual inspection and improves the user's control and feel of the projectile during drawing and release. Another advantage of such termination is that it permits the user to load the projectile into the rearward portion of the guide member.

The projectile 32 includes a head portion 52 and 54. The portion 52 of the head can be made of material of greater mass than the body portion. Such pointed head portions are readily available from stock and can be glued or welded to the tapered head portion 54. The projectile body and tapered head portion are suitable for low-cost plastic molding. The entire projectile can also be made of plastic or other suitable material and be of one-piece construction. The projectile is also provided with a conventional nock 56 for engaging the bowstring. The projectile can also be manufactured with a shallow modified nock or with a blunt end. Other types of heads may be employed, such as blunts or broadheads. An aperture or opening 58 extends vertically through the body portion of the projectile to provide means to extract the projectile from a target. A tool can be inserted into the aperature to obtain leverage for easy removal of the projectile. The body portion of the projectile has a substantially flat top portion 60 and a substantially flat bottom portion 62 which extend out to opposite side portions 64. During movement in the guide member the projectile side portions 64 engage the guide member side portions 30. The opening 58 is positioned in the lateral center of the body portion between the opposite side portions 64. The opening is elongated and extends longitudinally in the lateral center of the projectile.

The engagement of the projectile grooves and the ridges on the exposed portion of the guide member is important in preventing ejection of the projectile from the guide member during a sudden initial acceleration of the projectile as it is propelled forwardly by the bowstring.

The grooves on the projectile extend longitudinally and parallel to the opposite sides of the projectile. The grooves also extend along the lateral center of the projectile. The grooves preferrably terminate on the forward body portion of the projectile as seen in FIG. 2A, but can be extended through both forward and rearward portions and also through the head portion. The termination of the grooves in the forward portion increases the forward mass of the projectile for more stable flight.

The support 22, FIG. 4, includes a mounting plate 66, a rearwardly extending arm 68, and a pair of side plates 70 on the rearward portion of the arm. The support also includes a pivotable portion 72 which is pivotably supported on the side plates by a shaft 74. The pitovable portion allows the guide member to pivot during rearward drawing and shooting movements. The pivotable portion also restricts rotating movement of the guide member during such drawing and shooting movements. A pair of rollers 76 and 78 are positioned on the pivoting portion 72 below the shaft 74. The support also includes a resilient spring 80 which engages the rollers.

The spring exerts an upward tension on the rollers 76 and 78. This tension aligns the guide member in a shooting alignment substantially perpendicular with the longitudinal axis of the bow. Such perpendicular alignment is indicated by broken lines 82 and is substantially parallel to the guide member. Lines 82 also are substantially parallel to the horizontal plane of the arrow shelf. When the bowstring is drawn some vertical movement often occurs. The rocking engagement of the rollers with the spring allows the guide member to move vertically with the bowstring. The vertical movement of the guide member is indicated by broken lines 84 and the drawn position of the guide member is indicated by broken lines 86.

The feature allowing such vertical movement of the guide member is important since it reduces drag to provide a smooth draw. Furthermore, when the projectile is being propelled forwardly, the vertical movement of the guide member with the bowstring reduces friction between the bowstring, the projectile and the guide member. Such reduction of friction improves projectile speed.

Another feature of the support is that it allows pivoting or compacting of the guide member to a position substantially parallel with the longitudinal axis of the bow. This pivoted position of the guide member is indicated by broken lines 88.

During pivoting movements of the guide member, the mounting plate 22, the arm 68, the spring 80 and the side plates 70 of the support 22 remain stationary with the bow while the pivoting portion 72 of the support pivots with the guide member.

Another feature of the pivoting action of the guide member and support is the over-centering action of the rollers 76 and 78 in relation to shaft 74. During initial pivoting movements of the guide member, resistance to such pivoting occurs due to the rocking action of the rollers, and when the guide member is fully pivoted downwardly, the roller 76 will pass the vertical alignment of the shaft and urge the guide member to remain pivoted. The vertical alignment of the shaft is indicated by broken lines 90, such line being perpendicular to the horizontal plane of the arrow shelf 18.

The guide member can be pivoted by a simple downward or upward pressure on such guide member. The pivoting can be accomplished without the need for unlocking or release mechanisms. This is an important feature for convenience and speed of pivoting the guide member to the compacted position or to a shooting position. Such compacted position is desirable when displaying in stores, loading in cars or carrying.

Importantly, when the guide is in a compacted position, the arm 68 positions the pivoting portion 72 and the guide member 24 rearwardly of the bow frame 10 and the arrow shelf 18. This rearwardly positioning of the guide member allows the user to comfortably carry the bow by the grip without undue interference from the elongated guide member. Furthermore, such rearwardly positioning of the pivoting portion of the support and the guide member also allows the guide member to be pivoted to a position substantially parallel with the longitudinal axis of the bow. The rearwardly placement of the shaft 74 allows more pivoting movement of the guide member.

The bowstring slot 42, FIG. 3, narrows towards the lateral center of such slot on the rearward portion of the guide member. This narrow portion of the slot restricts lateral movement of the bowstring while allowing normal forward projectile propelling movements. This is an important feature since it also helps align the projectile during initial propelling movements while such projectile is in the exposed rearward portion of the guide member.

FIG. 9 shows the rearward portion of the guide member 24 but with the projectile indicated by broken lines 32' to more clearly show the ridges 40 on the bottom rails 28. It can be seen that such ridges extend up into the projectile to provide a guiding influence to such projectile. A rearward movement of the bowstring is restricted by web 48 connecting the pair of bottom rails 28 of the guide member. FIG. 6 shows the parallel side portions 30, top rails 26 and bottom rails 28 which form a longitudinal projectile guide path. The bottom rails and side portions allow the projectile to slide with a non-rotating movement.

Another important feature of this disclosure is that the projectile can be loaded into the rearward portion of the guide member without a draw force being applid to the bowstring.

Figure 10:
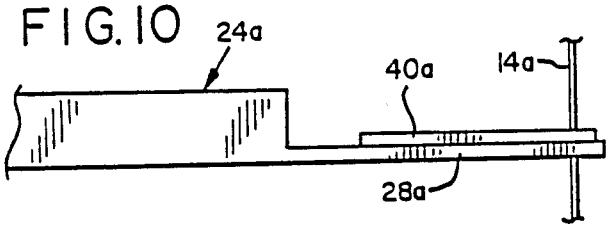
FIG. 10 is a side elevational view of another form of a guide member embodying principles of the present invention.

With reference to FIG. 10 another form of a rearward portion of a guide member is shown. This form is similar to that shown in FIG. 9 but without the pivoting feature and includes a guide member **24*a*, a pair of bottom rails 28*a*, raised portions or ridges 40*a* for engaging the groove in the projectile, and a bowstring 14*a***. The projectile for this embodiment can be loaded into the front end of the guide member.

Figure 11:
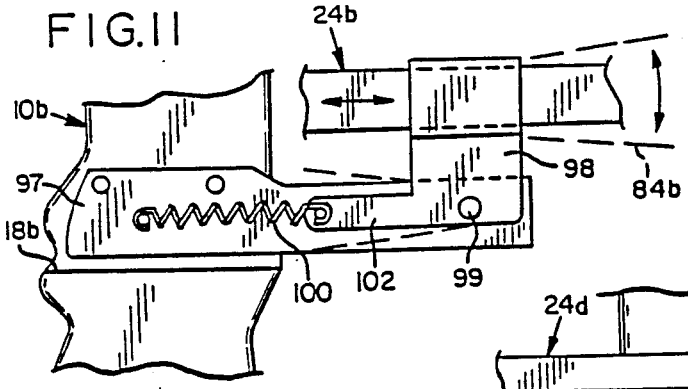
FIG. 11 is a side elevational view of another form of a support embodying principles of the present invention.

Referring to FIG. 11 another form of a support is provided which allows vertical movement of the guide member during drawing and shooting movements. Support 97 is provided to support pivotable portion 98 which slidably supports guide member **24*b*. The pivoting portion is pivotably supported by shaft 99. The pivoted positions of the guide member are indicated by broken lines 84*b*. An elongated resilient spring 100 is connected to the non-pivoting portion of the support and a forwardly extending extension 102** of the pivoting portion. This spring urges the guide member to maintain a horizontal shooting alignment while allowing it to move vertically with the bowstring.

Figure 12:
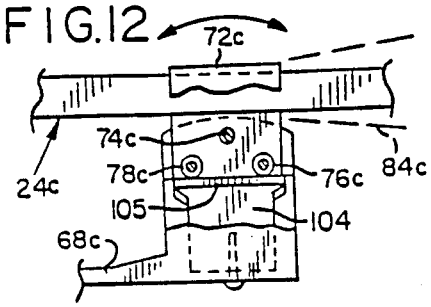
FIG. 12 is a side elevational view of still another form of a support embodying principles of the present invention.

Referring to FIG. 12 another form of a support is shown. This form is similar to that of FIG. 4 but the resilient tension is provided by a rubber spring 104. The rubber spring performs the same functions as the resilient spring 80, FIG. 4. It allows vertical movement of the guide member during drawing and shooting movements while urging the guide member to align in a horizontal shooting position. This guide member can also be pivoted to a position substantially parallel with the longitudinal axis of the bow. The rollers **76*c* and 78*c* also will pass vertical center in relation to shaft 74*c* and urge the guide member to remain in pivoted position. The rubber spring is shown in this embodiment, however, other forms of compression springs may be employed to perform the same function. A platform 105** is also provided for the rollers.

Figure 13:
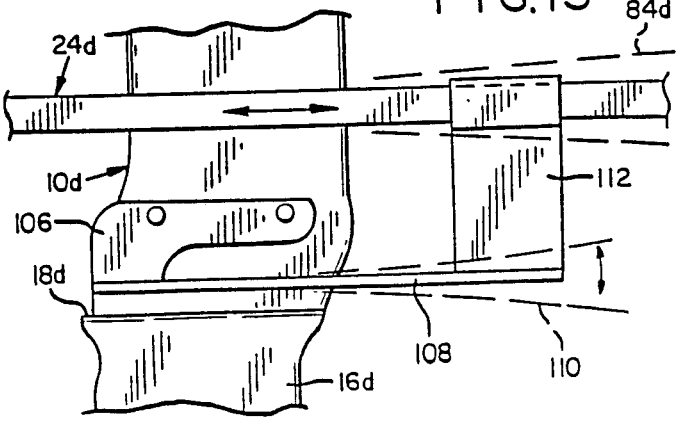
FIG. 13 is a side elevational view of still another form of a support embodying principles of the present invention.

Referring to FIG. 13 another form of a support is provided. The tension for this support is provided by spring arm 108 on support 106. The arm allows vertical movement of the guide member during drawing and shooting movements of the guide. Such vertical movement is indicated by broken lines 110 and **84*d*. The support also includes a riser 112 which slidably supports the guide member 24*d***.

Figure 14:
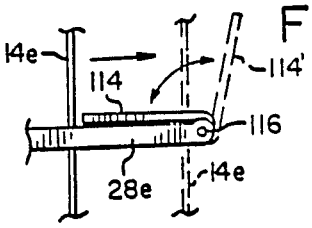
FIG. 14 is a side elevational view of still another form of a guide member embodying principles of the present invention.
Figure 15:
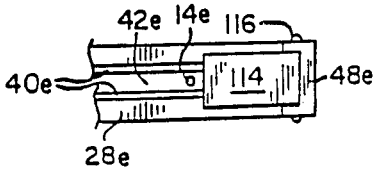
FIG. 15 is a top plan view of the guide member shown in FIG. 14.

Referring to FIGS. 14 and 15, another form of a rearward portion of a guide member is provided. The hinged portion 114 is movable and is pivotably hinged to the rearward portion of rails **28*e* by a pin 116. In the closed position shown the hinged portion restricts a rearward movement of a bowstring 14*e*. The hinged portion in such closed position positions the bowstring forwardly of web 48*e*. An open or projectile loading position of the bowstring and the hinged portion is indicated by broken lines 14*e'* and 114'. In such open position of the hinged portion, a rearward movement of the bowstring is restricted by web 48*e*. Raised portions or projectile aligning ridges 40*e* extend along bowstring slot 42*e***.

Figure 16:
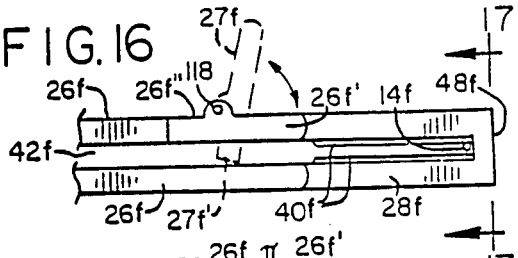
FIG. 16 is a top plan view of still another form of a guide member embodying principles of the present invention.
Figure 17:
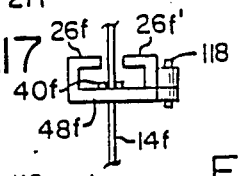
FIG. 17 is a rear elevational view taken on line 17—17 of FIG. 16.

Referring to FIGS. 16 and 17, still another form of a rearward portion of a guide member is provided. A pair of top rails **26*f* are similar to the top rails 26 seen in FIG. 3. The rails 26*f* include a laterally movable or pivotable portion 26*f'* shown in a closed position. Such portion is also shown in an open position by broken lines 27*f*. The open position being for loading a projectile and the closed position being for shooting a projectile. A web 48*f* connects two bottom rails 28*f* and restricts a rearward movement of a bowstring 14*f* in a bowstring slot 42*f*. A pin 118 pivotably supports the movable portion. Raised portions or aligning ridges 40*f* extend longitudinally and parallel to the bowstring slot. The bottom rails are similar to those shown in FIG. 10**.

The parallel rails **26*f* and 28*f* provide a projectile pathway for slidably supporting and guiding a projectile therebetween. In the open position, a portion 26*f''* of the movable portion 26*f'* extends into the projectile pathway. This is indicated by broken lines 27*f'***. The projectile is of sufficient length that during an initial loading movement the projectile will engage such movable portion.

When the projectile is loaded into the guide member, the movable portion **26*f'*** is moved to the closed position. It can be seen that such movable portion must be in a substantially closed position when a projectile is in the loaded position in the guide member. This important safety feature makes it difficult to accidentally shoot a projectile with the movable portion in the open or loading position.

Figure 18:
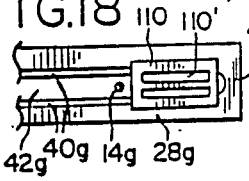
FIG. 18 is a top plan view of still another form of a guide member embodying principles of the present invention.
Figure 19:
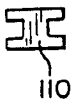
FIG. 19 is a rear elevational view of the rubber spring shown in FIG. 18.

Referring to FIGS. 18–19, still another form of a rearward portion of a guide member is provided. A movable or slidable rubber spring with slots 110' is positioned in a bowstring slot 42g on rearward portion of two bottom rails 28g, such rails being similar to that seen in FIG. 10. FIG. 18 shows the loading device in a closed position for shooting. The rubber spring pushes the bowstring 14g forwardly, preventing a projectile from being loaded. To open the device to a loading or open position, the user slides the guide member and the spring forwardly against a bowstring 14g compressing the spring between the bowstring and the web 48g. The compression of the spring allows sufficient space for a projectile to be loaded. The rubber spring is employed in this embodiment, however, other forms of sliding devices or compression springs may be employed to perform the same function.

It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. For use with a bow of the type having a bowstring, means to support a projectile shooting guide and tensioning means connected to the bowstring, a projectile shooting guide comprising an elongated guide member including forward and rearward portions and in an operative position said elongated guide member is positioned transversely to a bowstring and said rearward portion extends rearwardly towards a bowstring, said elongated guide member also including an elongated bottom portion, said elongated guide member also including a vertically extending elongated bowstring slot extending longitudinally along said elongated bottom portion for receiving a bowstring, said slot allowing drawing and shooting movements of the bowstring in the guide member, said guide member also including an elongated raised portion positioned on said bottom portion of said guide member for engaging and aligning a projectile during its initial forwardly shooting movements, said elongated raised portion extending upwardly from said elongated bottom portion, said elongated raised portion also extending longitudinally along said elongated bottom portion, said elongated raised portion including a pair of elongated opposite side portions extending upwardly from said elongated bottom portion, said elongated opposite side portions also extending longitudinally on said elongated bottom portion, said elongated side portions of said elongated raised portion also extending parallel to a shooting movement of a projectile to restrict its lateral and rotating movements so that during an initial propelling movement by a bowstring a projectile will be aligned with said elongated bottom portion and driven forwardly in a non-rotating movement, said bowstring slot extending longitudinally through said raised portion to allow drawing and shooting movements of the bowstring in said raised portion.

2. The shooting guide of claim 1 wherein said bowstring slot extends longitudinally between said elongated side portions of said raised portion.

3. For use with a bow of the type having a bowstring and tensioning means connected to the bowstring, a projectile shooting guide comprising a support for supporting a projectile guide member, said support being mounted for use on a bow, an elongated guide member for support on a bow by said support, said guide member including forward and rearward portions and in an operative position said rearward portion extends rearwardly from said support, projectile guiding means in said guide member for guiding a projectile to be shot by a bowstring, said support slidably supporting said guide member, and loading means positioned on said rearward portion of said guide member for loading a projectile into said guide member, said guide member having a forwardly undrawn position and a rearwardly drawn position, said loading means having an open position for loading a projectile into said guide member and a closed position for propelling a projectile in said guide member, said loading means being movable from said closed position to said open position while said guide member is in said forwardly undrawn position, said rearward portion of said guide member including a pair of parallel portions for slidably supporting a projectile therebetween and for receiving a bowstring therebetween for propelling a projectile, a portion of said parallel portions being pivotable to load a projectile.

4. The projectile shooting guide of claim 3 wherein said pair of parallel portions each includes a top rail and a bottom rail respectively and a portion of one of said top rails being pivotable to load a projectile onto said guide member.

5. For use with a bow of the type having a bowstring, means to support a projectile shooting guide and tensioning means connected to the bowstring, the bowstring including a rest or undrawn position and a rearwardly drawn position, a projectile shooting guide comprising an elongated guide member including forward and rearward portions and in an operative position said elongated guide member is positioned transversely to a bowstring, loading means positioned on said rearward portion of said guide member for loading a projectile onto said guide member, said loading means including a loading position and a shooting position, said loading position of said loading means allowing a projectile to be loaded onto said rearward portion of said guide member, said shooting position of said loading means causing a loaded projectile's upwardly movements to be restricted, said loading means allowing a projectile to be loaded onto said rearward portion of said guide member in front of a bowstring before a draw force is applied to a bowstring and the latter is in an undrawn rest condition.

6. The shooting guide of claim 5 wherein said loading means is positioned in front of a bowstring when the latter is in a undrawn condition.

7. The shooting guide of claim 5 wherein said guide member includes an elongated bowstring slot extending in a shooting direction of a bowstring, said loading means in said shooting position extends into said bowstring slot for engaging a bowstring in its undrawn rest condition and said loading means in said loading position is moved at least partially away from said bowstring slot.

8. The shooting guide of claim 5 wherein said guide member includes an elongated bowstring slot extending in a shooting direction of a bowstring, said loading means including a resilient device positioned in said bowstring slot.

9. For use with a bow of the type having a bowstring and tensioning means connected to the bowstring, a projectile shooting guide comprising a support for supporting a projectile guide member, said support being mounted for use on a bow, an elongated guide member for support on a bow by said support, said guide member including forward and rearward portions and in an operative position said rearward portion extends rearwardly from said support, projectile guiding means in said guide member for guiding a projectile to be shot by a bowstring, and said support including means to allow vertical movement of said guide member during drawing and shooting movements of said guide member, said guide member also including a shooting position substantially perpendicular to a longitudinal axis of a bow, said shooting guide also including resilient means for urging said guide member to maintain said shooting position during drawing and shooting movements of said shooting guide.

10. For use with a bow of the type having a bowstring and tensioning means connected to the bowstring, a projectile shooting guide comprising a support for supporting a projectile guide member, said support being mounted for use on a bow, an elongated guide member for support on a bow by said support, said guide member including forward and rearward portions and in an operative position said rearward portion extends rearwardly from said support, projectile guiding means in said guide member for guiding a projectile to be shot by a bowstring, and said support including means to allow vertical movement of said guide member during drawing and shooting movements of said guide member.

said guide member also including a shooting position substantially perpendicular to a longitudinal axis of a bow, said shooting guide also including resilient means for urging said guide member to maintain said shooting position during drawing and shooting movements of said shooting guide, said resilient means being positioned under said guide member.

11. For use with a bow of the type having a bowstring and tensioning means connected to the bowstring, a projectile shooting guide comprising a support for supporting a projectile guide member, said support being mounted for use on a bow, an elongated guide member for support on a bow by said support, said guide member including forward and rearward portions and in an operative position said rearward portion extends rearwardly from said support, projectile guiding means in said guide member for guiding a projectile to be shot by a bowstring, and said support including means to allow vertical movement of said guide member during drawing and shooting movements of said guide member, said guide member also including a shooting position substantially perpendicular to a longitudinal axis of a bow, said shooting guide also including resilient means for urging said guide member to maintain said shooting position during drawing and shooting movements of said shooting guide, said support also including a forward portion and a rearward portion and said resilient means comprises an elongated spring extending between said forward portion and said rearward portion of said support.

12. For use with a bow of the type having a bowstring and tensioning means connected to the bowstring, a projectile shooting guide comprising a support for supporting a projectile guide member, said support being mounted for use on a bow, an elongated guide member for support on a bow by said support, said guide member including forward and rearward portions and in an operative position said rearward portion extends rearwardly from said support, projectile guiding means in said guide member for guiding a projectile to be shot by a bowstring, and said support including means to allow vertical movement of said guide member during drawing and shooting movements of said guide member, said guide member also including a shooting position substantially perpendicular to a longitudinal axis of a bow, said shooting guide also including resilient means for urging said guide member to maintain said shooting position during drawing and shooting movements of said shooting guide, said resilient means comprising a flexible arm supporting said guide member.

13. For use with a bow of the type having a bowstring and tensioning means connected to the bowstring, a projectile shooting guide comprising a support for supporting a projectile guide member, said support being mounted for use on a bow, an elongated guide member for support on a bow by said support, said guide member including forward and rearward portions and in an operative position said rearward portion extends rearwardly from said support, projectile guiding means in said guide member for guiding a projectile to be shot by a bowstring, said support slidably supporting said guide member, and loading means positioned on said rearward portion of said guide member for loading a projectile into said guide member, said guide member having a forwardly undrawn position and a rearwardly drawn position, said loading means having an open position for loading a projectile into said guide member and a closed position for propelling a projectile in said guide member, said loading means being movable from said closed position to said open position while said guide member is in said forwardly undrawn position, said guide member including a pair of parallel portions for slidably supporting a projectile therebetween and for receiving a bowstring therebetween for propelling a projectile, said pair of parallel portions each having a top rail and a bottom rail respectively, a portion of each of said bottom rails being pivotable to load a projectile into said guide member.

14. For use with a bow of the type having a bowstring and tensioning means connected to the bowstring, a projectile shooting guide comprising a support for supporting a projectile guide member, said support being mounted for use on a bow, an elongated guide member for support on a bow by said support, said guide member including forward and rearward portions and in an operative position said rearward portion extends rearwardly from said support, projectile guiding means in said guide member for guiding a projectile to be shot by a bowstring, said support slidably supporting said guide member, and loading means positioned on said rearward portion of said guide member for loading a projectile into said guide member, said guide member having a forwardly undrawn position and a rearwardly drawn position, said loading means having an open position for loading a projectile into said guide member and a closed position for propelling a projectile in said guide member, said loading means being movable from said closed position to said open position while said guide member is in said forwardly undrawn position, said rearward portion of said guide member including a non-pivotable portion and a pivotable portion, said loading means including a spring device connecting said pivotable portion and said non-pivotable portion of said guide member.

* * * * *